US010590581B1

(12) United States Patent
Weiner et al.

(10) Patent No.: US 10,590,581 B1
(45) Date of Patent: Mar. 17, 2020

(54) COMPACT CREEL CONSTRUCTION

(71) Applicants: Robert S. Weiner, Atlanta, GA (US); David Brian Porter, Dalton, GA (US)

(72) Inventors: Robert S. Weiner, Atlanta, GA (US); David Brian Porter, Dalton, GA (US)

( * ) Notice: Subject to any disclaimer, the term of this patent is extended or adjusted under 35 U.S.C. 154(b) by 46 days.

(21) Appl. No.: 16/003,230

(22) Filed: Jun. 8, 2018

Related U.S. Application Data

(60) Provisional application No. 62/542,559, filed on Aug. 8, 2017.

(51) Int. Cl.

| | |
|---|---|
| ***D05C 15/18*** | (2006.01) |
| ***B65H 57/06*** | (2006.01) |
| ***B65H 57/12*** | (2006.01) |
| ***B65H 49/16*** | (2006.01) |
| *B65H 49/12* | (2006.01) |

(52) U.S. Cl.
CPC ..... *D05C 15/18* (2013.01); *B65H 49/16* (2013.01); *B65H 57/06* (2013.01); *B65H 57/12* (2013.01); *B65H 49/12* (2013.01); *B65H 2701/31* (2013.01); *D05D 2305/14* (2013.01)

(58) Field of Classification Search
CPC ..... B65H 49/10; B65H 49/12; B65H 49/14; B65H 49/16
See application file for complete search history.

(56) References Cited

U.S. PATENT DOCUMENTS

| | | | | |
|---|---|---|---|---|
| 2004/0050995 | A1* | 3/2004 | Ingram, III | B65H 49/16 242/594.6 |
| 2007/0084960 | A1* | 4/2007 | Heaney | B65H 49/12 242/551 |
| 2012/0217337 | A1* | 8/2012 | Barea | B65H 49/16 242/563 |

* cited by examiner

*Primary Examiner* — William E Dondero
(74) *Attorney, Agent, or Firm* — Stephen J. Stark; Miller & Martin PLLC

(57) ABSTRACT

A compact creel utilization method provides arms cantileverdly extending from supports which support at least two yarn rolls thereon. Some embodiments have a front roll connected to the rear roll. Other embodiments simultaneously feed to a common eyelet or other feed opening.

12 Claims, 1 Drawing Sheet

10
14
12
26
30
32
24
28

20
22
30
12
16
32
14
18
24
28

10
38
52
40
43
50
46
12
42

28
15
2
38
36
14
10
13
21
24

COMPACT CREEL CONSTRUCTION

CLAIM OF PRIORITY

This application claims the benefit of U.S. Provisional Application No. 62/542,559 filed Aug. 8, 2017, which is incorporated herein by reference in its entirety.

FIELD OF THE INVENTION

The present invention relates to a compact creel for use normally with tufting machines and more particularly to structures and methods of utilizing a linear stacked yarn roll arrangement which is particularly attractive for at least short length of carpet runs, accent yarns and/or other purposes.

BACKGROUND OF THE INVENTION

Creels have been in existence most likely since the existence of tufting machines which date back to the early 1960s or before. Tufting machines are the machines that make carpet by directing one or more yarns to specific needles in one or more rows of needles which then proceed through backing to make tufts. Further finishing is often provided before the carpet is sold to a consumer.

In the prior art, a yarn roll would be provided at a specific location on a creel on an arm; one yarn roll per arm. The tail end of that yarn roll would then typically be tied to an adjacent yarn roll so that when the first roll is exhausted, the second roll would begin to be fed to the same needle without interruption. These adjacent yarn cone holders are normally called "bullhorns" because they point towards one another and are directed at the same eye which begins to direct yarn to the appropriate needle. However, the bullhorn style creel construction takes up a good bit of space as sufficient room must be left for the proper feeding from both of the rolls.

The bullhorn construction, while useful in various applications, it is not necessarily best suited for all applications. For instance, if a need exists to provide a compact creel, the bullhorn style construction may not provide sufficient compaction. Other motivations may produce a need for an improved holder for yarn rolls, such as a creel or other devices, as well.

SUMMARY OF THE INVENTION

Accordingly, is a present object of many embodiments of the present invention to provide an improved creel construction.

It is another object of many embodiments of the present invention to provide an improved yarn roll feed arrangement.

It is another object of many embodiments of the present invention to provide an improved stacked yarn roll configuration for various applications.

Accordingly, in accordance with at least some presently preferred embodiments of the present invention, at least two yarn cones can be stacked in a linear arrangement on a support, such as an arm, extending from a creel or other structure, most likely pointed toward an eyelet which directs the yarn to a specific needle of a tufting machine. As one can see from the figures, a colinear yarn roll construction could feed rotatably oppositely off their respective cones so that the yarns combine at the eyelet when fed at the same time. As long as the forward yarn cone is the same or smaller size than the rear cone, then this arrangement has been found to work satisfactory when feeding yarn ends from the linearly arranged yarn cones at the same time. Although only two yarn cones are shown, obviously three or more could be mounted in a similar manner.

It is worth observing that on successive cones using this construction, the offtake direction of the yarns can be in opposite directions so that they preferably do not become entangled as they are fed toward the eyelet. Other embodiments may offtake in the same direction, possibly using additional structure before the eyelet.

For these or other embodiments, the yarn cones can be loaded on the same post or arm in a collinear arrangement. Some embodiments, in a collinear arrangement, can direct a single yarn to the eyelet at a time. Specifically, after the front yarn cone is exhausted, instead of the yarn end being tied to a yarn cone at a different lateral location on the creel like is done in prior art, the rearward cone begins feeding at that the same location on the creel just from a rearwardly located yarn cone.

The adjacent yarn cone supports, and not just as it relates to vertically adjacent as is done in the past, but horizontally adjacent supports as well can be linearly disposed instead of angled towards a common eyelet as has been done in the prior art with bullhorn style arrangements. With bullhorn construction, linearly horizontally adjacent yarn cones point at the same eyelet so that after the yarn is pulled off of one cone, it then begins to be pulled off the linearly adjacent one of a bullhorn pair.

While some embodiments of the present invention can accommodate bullhorn style creels, the stacking arrangement as shown and described herein is believed to be novel over prior art constructions and can provide more compact creels for at least some embodiments.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figures 1, 2, 3, 4:
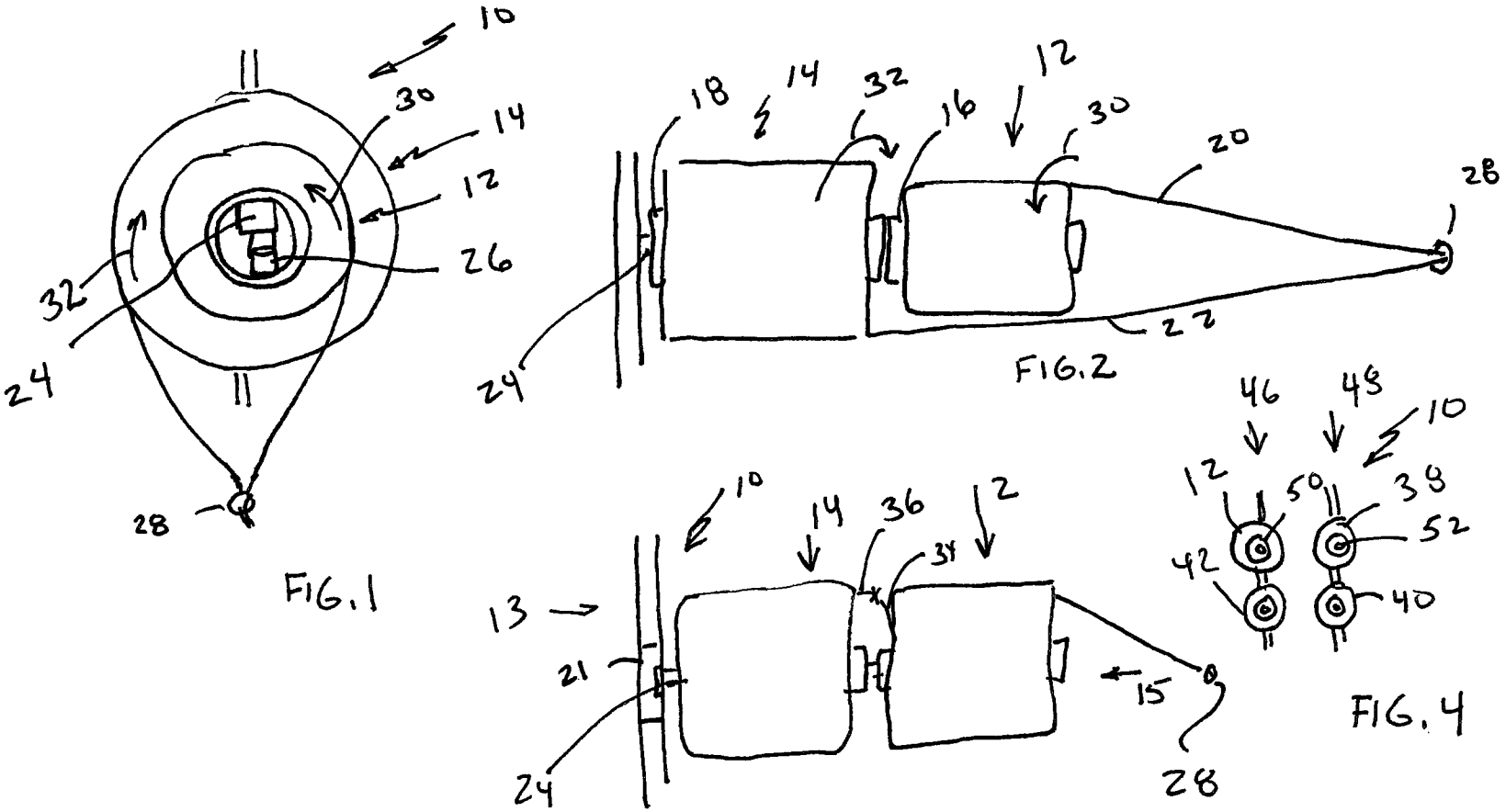
FIG. 1 is a front plan view of the presently preferred embodiment of a present invention.
FIG. 2 shows a side plan view of FIG. 1.
FIG. 3 shows the same order of yarn cones as is shown in FIGS. 1 and 2 but with a different takeoff method.
FIG. 4 shows a portion of a creel showing tighter spacing as has been accomplished with prior art constructions which may be useful for at least some applications.

FIG. 1 shows a front plan view of the presently preferred embodiment of the present invention in the form of a portion of a creel 10 having first and second yarn rolls 12,14 being in the form of first and second yarn cones 16,18 having at least one yarn strand 20,22 wound respectively thereabout and then located on a single arm 24 which may have such items as one or more spring retainers 26 connected thereto to which may assist in retaining one or both of the yarn rolls or cones 16,18 to the arm 24. The arm 24 extends cantileveredly in many embodiments relative to a support 27. Supports 27 can generally assist to form rows 46,48.

In the prior art, an arm is constructed to hold only a single yarn cone and is not constructed to be of suitable length to hold a second yarn cone (or more) in a colinear arrangement with another yarn cone.

FIGS. 1 and 2 show a first and second yarn rolls 12,14 with the front yarn roll 12 being no greater in diameter than the rearward yarn roll, or second yarn roll 14 for at least some embodiments.

More than two yarn rolls 12,14 might be appropriate for other embodiments. An ability to add a third and successive yarn rolls from the back 13 at detachable connection 21 may assist for some embodiments as yarn may continue to be fed from the front 15 while adding yarn from behind. For example, spent rolls could be removed from the front, the remaining rolls pushed toward the front, and new roll(s) added from the rear. More particularly, the illustrated embodiment shows where the yarns 20,22 are being fed to the same eyelet 28 to then be fed ultimately to the same needle 23 of a tufting machine 25 from the stacked yarn rolls 12,14. In this embodiment one will notice that the direction of feed 30 to the front 15 of the first yarn roll 12 is oppositely directed from the direction of feed 32 of the second yarn roll 14 (i.e. the direction the yarns 20,22 come off the yarn rolls 20,22). The applicants discovered that if they feed in the same direction of feed to the same feed opening or eyelet 28 they tend to sometimes become entangled and create problems during the feeding process. Feed openings could be an eyelet 28, a tube opening and/or other pathway whereby the yarn(s) are fed to a needle 23 of a tufting machine 25. However, by reversing the directions 30,32 relative to one another, then the yarns 20,22 can feed cleanly to the eyelet 20. Other embodiments may be able to proceed in a common direction of feed. Some other embodiments may accommodate more yarn rolls 12,14 in a stacked linear arrangement.

For some applications such as short runs, this construction has advantage over the prior art in that multiple yarns 20,22 can be jointly fed to a single needle (eyelet 28) from a single arm 24 of the creel 10. This can eliminate twisting and/or other joining steps (two yarns or more together) possibly practiced in the prior art.

Still other embodiments may utilize this advanced construction of an arm 24 which is configured to hold at least first and second yarn rolls 12,14 thereon in a secure manner that they both can feed yarns 20,22 toward a single eyelet 28. Specifically this same construction as shown in FIG. 3 with creel 10 having arm 24 feeding first and second yarn rolls 12,14 to a single eyelet 28 in succession with the tail end 34 of the first yarn roll 12 tied to the lead yarn end 36 of the second yarn roll 14 so that they can potentially double the amount of yarn that can be provided by a single arm 24. This application may be desirable for various embodiments so that a specific length of yarn is known to be on the creel 10 when beginning the process and may be attractive for other applications such as various short yarn applications for at least some of the yarns and/or other applications.

As can be seen with reference to FIG. 4, the adjacent vertically extending rows 46,48 of yarn rolls 12,42 on first row 46 and yarn rolls 38,40 on second roll 48 need not necessarily be angled toward one another to a common eyelet 28 as has occurred in the prior art, but could have arms 50,52 etc. which are parallel to one another instead of angled toward one another acutely. This construction could allow rows 46,48 to be closer to one another as occurred in prior art constructions as they would be feeding separate eyelets for at least some constructions.

Of course, bullhorn style construction could be utilized with the yarn cone arrangement as shown above for FIGS. 1-3 and/or for various other embodiments which might be desirable for short runs, accent colors and/or other purposes as would be understood by those of ordinary skill in the art and others.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method of feeding from a compact creel comprising the steps of:

a) providing a creel having arms extending cantileveredly relative to supports toward fronts of the arms;

b) placing at least first and second yarn rolls on an arm of the creel colinearly as a first pair and then directing at least one yarn strand from each of the first and second yarn rolls toward and through a common feed opening on to a single needle of a tufting machine by adjacently feeding of the at least one yarn strand from the first and second yarn rolls simultaneously.

2. The method of claim 1 wherein the at least one yarn strand unrolls off the first yarn roll in an opposite direction as the at least one yarn strand unrolls off the second yarn roll.

3. The method of claim 1 further comprising a second pair disposed vertically above the first pair along one of the supports in a first row.

4. The method of claim 1 further comprising a third pair disposed horizontally relative to the first pair along a second of the supports in a second row.

5. The method of claim 1 further comprising the step of providing at least one retainer to thereby bias at least one of the first and second yarn rolls to the arm.

6. The method of claim 1 wherein the first yarn roll is a front yarn roll having a diameter no greater than the second yarn roll disposed rearwardly of the first yarn roll.

7. The method of claim 1 wherein the first and second yarn rolls are securedly retained on the arm.

8. The method of claim 1 wherein the feed opening is one of an eyelet and an opening into a feed tube.

9. A method of feeding yarn from a compact creel comprising the steps of:

a) providing a creel having an arm extending cantileveredly from a support toward a front of the arm;

b) placing at least first and second yarn rolls on the arm colinearly as a first pair and then directing at least one yarn strand from the first and second yarn rolls toward and through a common feed opening directing the at least one yarn strand to a single needle of a tufting machine by adjacently feeding of the at least one yarn strand from the first and second yarn rolls simultaneously.

10. The method of claim 9 wherein the at least one yarn strand unrolls off the first yarn roll in an opposite direction as the at least one yarn strand unrolls off the second yarn roll.

11. The method of claim 9 wherein the first and second yarn rolls are securedly retained on the arm.

12. The method of claim 9 wherein the feed opening is one of an eyelet and an opening into a feed tube.

* * * * *